US009728291B2

(12) United States Patent
Petti

(10) Patent No.: US 9,728,291 B2
(45) Date of Patent: Aug. 8, 2017

(54) CONTROLLED ORIENTATION CONTAINERS

(71) Applicant: BTG International Canada Inc., Ottawa (CA)

(72) Inventor: Luca Petti, Ottawa (CA)

(73) Assignee: BTG International Canada, Inc., Ottawa, Ontario ( * ) Notice: Subject to any disclaimer, the term of this patent is extended or adjusted under 35 U.S.C. 154(b) by 0 days.

(21) Appl. No.: 15/125,987

(22) PCT Filed: Mar. 17, 2015

(86) PCT No.: PCT/IB2015/000356

§ 371 (c)(1),
(2) Date: Sep. 14, 2016

(87) PCT Pub. No.: WO2015/140621

PCT Pub. Date: Sep. 24, 2015

(65) Prior Publication Data

US 2017/0004896 A1 Jan. 5, 2017

(30) Foreign Application Priority Data

Mar. 17, 2014 (GB) ..... 1404769.0

(51) Int. Cl.

| | |
|---|---|
| ***G21F 5/015*** | (2006.01) |
| ***B65D 85/00*** | (2006.01) |
| ***G21F 5/06*** | (2006.01) |
| ***G21F 3/00*** | (2006.01) |
| ***B65D 25/10*** | (2006.01) |
| *G21F 1/00* | (2006.01) |

(52) U.S. Cl.
CPC ..... *G21F 5/015* (2013.01); *B65D 25/10* (2013.01); *B65D 85/70* (2013.01); *G21F 3/00* (2013.01); *G21F 5/06* (2013.01); *B65D 2303/00* (2013.01); *G21F 1/00* (2013.01)

(58) Field of Classification Search
CPC ..... G21F 1/00; G21F 3/00; G21F 5/06; G21F 5/015; B65D 25/00; B65D 25/10; B65D 85/00; B65D 85/70
IPC ..... B65D 25/00,25/10, 85/00, 85/70
See application file for complete search history.

(56) References Cited

U.S. PATENT DOCUMENTS 3,085,157 A * 4/1963 Ginsburgh ..... G21F 5/015 109/84
3,731,101 A * 5/1973 Peterson ..... G21F 5/005 250/506.1

(Continued)

OTHER PUBLICATIONS

International Search Report for International Application No. PCT/IB2015/000356, Jul. 8, 2015.

*Primary Examiner* — David E Smith
(74) *Attorney, Agent, or Firm* — Finnegan, Henderson, Farabow, Garrett & Dunner, L.L.P.

(57) ABSTRACT

A packaging unit or a container for transport and/or storage of items that require orientation control, comprising an outer housing element and an inner retaining element, the retaining element being held within the housing element and capable of moving independently of the housing element about at least one axis the retaining element being adapted to retain the item and comprising a means for biasing the orientation of the inner retaining element with respect to a fixed external orientation.

11 Claims, 13 Drawing Sheets

(56) References Cited

U.S. PATENT DOCUMENTS

Figure 1A:
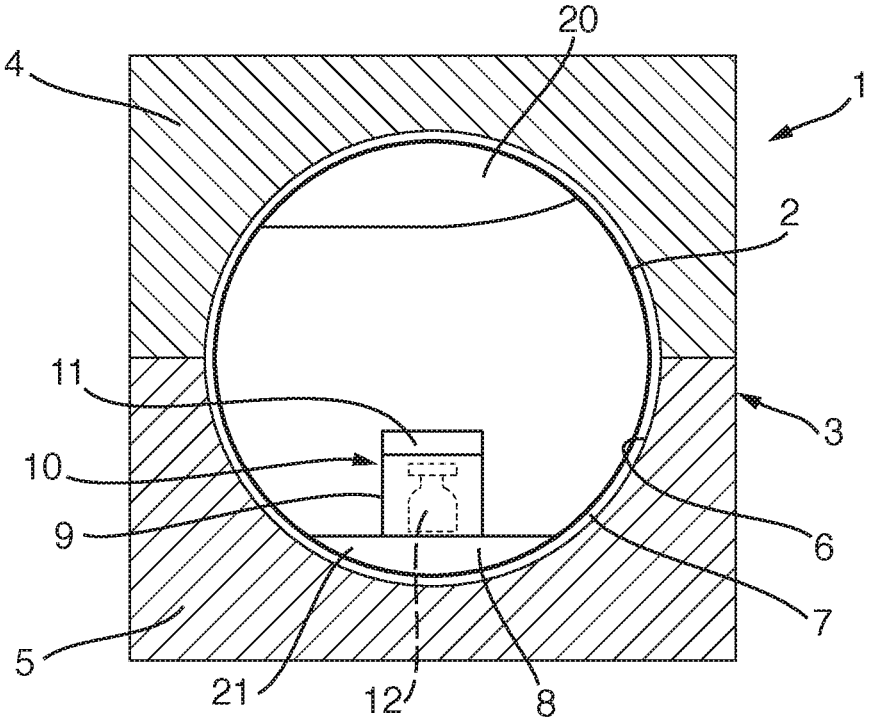

| | | | | |
|---|---|---|---|---|
| 4,190,160 | A * | 2/1980 | Andersen | G21F 9/36<br>188/377 |
| 6,642,906 | B1 * | 11/2003 | Machalek | H01Q 9/28<br>343/872 |
| 2006/0006351 | A1 * | 1/2006 | Timpert | G21F 5/005<br>250/506.1 |
| 2012/0067761 | A1 * | 3/2012 | Zibouche | G21F 5/002<br>206/524.1 |
| 2013/0092684 | A1 * | 4/2013 | Roger | G21F 5/012<br>220/4.01 |

* cited by examiner

CONTROLLED ORIENTATION CONTAINERS

This application is a national stage filing under 35 U.S.C. §371 of International Application No. PCT/IB2015/000356, filed on Mar. 17, 2015, which claims priority of British Patent Application No, GB 1404769.0, filed on Mar. 17, 2014. The contents of these applications are each incorporated herein by reference.

The present invention is made in the field of containers, and particularly relates to containers for materials that are desired to be maintained in a particular orientation during storage, use or transport. Such containers particularly include those having outer and inner elements, wherein the inner retaining element mounts an item requiring orientation control, particularly such as to maintain the item in an upright orientation, regardless of the orientation of the outer housing element, for example in order to prevent the inadvertent damage to or spillage from the item. The option of maintenance of an inner item orientation at an angle to vertical may also be provided.

Many containers bear markings to indicate in which orientation they should be maintained during storage, handling and transport. Nevertheless, handling errors often occur and packaged items may become mal-oriented in transit. Further, if subsequently returned to the correct orientation, it is not obvious that potential damage has occurred until the item comes to be used. It would therefore be advantageous to provide packaging that ensures that the packaged item remains in the appropriate orientation during transport, regardless of the orientation of the outer packaging.

One particular utility for the containers of this invention is in the handling, transport and storage of hazardous materials, particularly highly reactive chemicals or radioactive substances. Such materials may leak if their container is inverted, or damage may be caused to the seal of the container, if it becomes exposed directly to the contents. Further, exposure of container seals to such materials may make later handling on opening of the inner container hazardous. The transportation of radioactive materials, particularly in flowable, e.g., particulate, suspension or liquid form is a particularly envisaged use of the containers of invention.

Radiolysis in liquid, particularly aqueous, suspensions and solutions of radioactive materials can generate gases such as hydrogen. These gases can build up in sealed containers. These gases will vent naturally in containers that are not gas tight, but in gas tight containers gas build-up will increase pressure on the seal and may lead to leakage should the container become inverted. Furthermore, where particulate or liquid materials are inverted, particles or liquid adhering to the seal can be released when the seal is opened. Still further, high energy radioactive materials can damage seals through contact and compromise their operation, e.g., such as a septum's ability to allow sealing passage of a hypodermic needle for access of contents. It is therefore desirable to maintain the inner container, such as a vial, in an upright position during transport and storage such that the contents do not spend prolonged periods in direct contact with container closures such as seals or septa.

Preferably where the container is packaging for transport of an item this should not represent an inappropriately high cost in relation to the value of the goods being transported. The container should be of simple but robust construction and should ideally be easily recycled or reusable. Preferred containers of the invention are therefore constructed from disposable or recyclable materials or be re-usable.

The present inventor has identified that one or more of these aims or problems can be addressed by the present invention. In a first aspect the present invention provides a container or packaging unit for an item requiring orientation control comprising a) an outer housing element, and b) an inner retaining element, the inner retaining element being retained within the outer housing element and capable of moving independently of the outer housing element about at least one axis, the inner retaining element being adapted to releasably retain the item, the container or packaging unit additionally comprising a means for biasing the orientation of the inner retaining element with respect to a fixed external orientation.

In general, the retaining element is adapted to releasably retain the item by being provided with a retaining means for retaining the item. The retaining means is attached to the retaining element such that it rotates with the retaining element and holds the item in a preferred orientation.

Preferably the fixed external orientation is the direction of a centrifugal or gravitation force. The preferred orientation of the item can be any orientation which is beneficial during transport, for example that which provides protection to the item, or part thereof. In one embodiment the preferred orientation is generally upright. Such an orientation, for example, prevents the fluid contents of a vial coming into contact with the stopper or septum. It is contemplated, however that the item may not need to be held absolutely upright and a degree of upright that is 5, 10, 15, 20 or even 30 degrees off vertical will be sufficient in some cases. For other items it may be preferable to maintain them in a generally horizontal orientation and the same principles apply.

In one embodiment, the retaining element comprises the means for biasing the orientation of the inner retaining element with respect to a fixed external orientation. In a particular embodiment, this comprises a body, having sufficient mass with respect to the retaining element (when retaining the item requiring orientation control), to cause the retaining element to take up the desired orientation. This biasing mass is arranged such that an item held by the retaining element (e.g. in a retaining means) in a first orientation is maintained in that orientation as the outer housing element is rotated, or returns to that orientation once displaced. The mass, attached to the retaining element, provides a turning moment to the element, in an axis of rotation, sufficient to bias the mass towards its lowest point (relative to the direction of gravity) i.e. downwards. The biasing mass is sufficient to maintain the item in its preferred orientation whilst the outer housing is rotationally displaced or to return the retaining element to the preferred orientation following displacement. It is preferred, therefore, that the biasing mass is positioned to maximise the turning moment. Generally the turning moment is maximised when the mass is as far as possible from the rotational axis, it is therefore preferred that the biasing mass is placed at or near the periphery of the retaining element.

Since the retaining means is attached to the retaining element, the position and orientation of the retaining means relative to the biasing mass will hold the item in the preferred orientation, regardless of the rotation of the outer housing about the axis. Positioning and/or orienting the retaining means relative to the mass, thus provides the control of orientation required. The biasing mass thus acts to maintain the item in a preferred orientation.

By balancing the centre of mass of the biasing mass with that of the retaining means and item, the position of the item with respect to the fixed external orientation can be controlled. Placing the retaining means opposite the centre of biasing mass, with respect to the axis of rotation, allows the retaining means and hence the item to be biased upwards, i.e. towards the top of the retaining element. By placing the retaining means diametrically opposite the centre of mass of the biasing mass, the retaining means and hence the item are biased to the top of the retaining element. Equally, by placing the retaining means on the same side of the rotational axis as the centre of mass of the biasing mass, the item is biased towards the bottom of the retaining element, and placing it on a radius passing through the centre of mass, biases it to the bottom. It is understood that by careful selection of the mass and placement of the retaining means, the retaining means and item could be biased to any position required, however, for the sake of simplicity biasing generally towards the top or bottom is preferred.

The body may be a mass separate from, or independent of, the item or, where the item is of sufficient mass, it may be the item itself and a separate biasing mass is not necessary. In some cases a combination of the mass of the item and an additional mass, the total being sufficient to cause the retaining element, and thus the retaining means and item, to take up the desired orientation, may be used.

It is contemplated that containers and packaging according to the invention may be produced to suit a variety of items, of various masses. It is therefore contemplated that a single mass, sufficient to bias the retaining element to the desired position when items of a range of masses are retained can be used. It is also contemplated that packaging or containers may be provided where the mass of the body is matched to the mass of the item, such that the mass is sufficient to cause the retaining element to take up the desired position when that particular item is retained. In this way, packaging weight can be optimised for a particular item.

It is further contemplated that, where the mass of the retained item is sufficient to bias the retaining element such that the item takes up the desired orientation, then any packaging or container described herein may be provided without a biasing mass. This arrangement will result in the retaining element being biased such that the item is at the lowest point, i.e. at the bottom.

It is further contemplated that where the mass of the retained item is insufficient to cause the retaining element to take up the desired orientation, then any packaging or container described herein may be provided with a biasing mass that, together with the mass of the item, is sufficient to bias the retaining element to the position required.

In one particular embodiment, the container or packaging unit comprises a means for biasing the orientation of the inner retaining element; the retaining element or the housing element or both may comprise such means. The means to bias the orientation of the inner retaining element in this embodiment comprises driving means acting to drive the inner retaining element to a desired orientation relative to the outer housing element in response to a signal from a sensor which detects the orientation of the inner retaining element with respect the desired orientation. In this case the housing element or the retaining element or both comprise driving means, which preferably engage the other element such as to rotate it. These driving means may be driven by electrical or magnetic means, e.g. motors. It will be realised by those skilled in the art that driving means will be required that move the retaining element in at least two directions within the outer housing such as to allow a full 360 degree orientation change in the event the outer container is displaced. Driving means preferably operate to drive the rotation of the retaining element in X,Y and Z axes, mutually at right angles.

The inner retaining element is retained within the outer housing element. It is shaped such as to be free to rotate within it about at least one axis, an preferably about all axes of symmetry. The outer extremities of preferred retaining elements define a generally cylindrical, spherical or ovoid shape, preferred retaining elements are generally cylindrical, spherical or ovoid, for simplicity, although it will be understood that other shapes are possible. It is preferred that the retaining element is free from attachment to the housing element (i.e. is not linked to, and is separate from, the housing element), and this allows for free rotational movement about all axes, easy demounting of the retaining element from the housing and simple construction.

The retaining element comprises a retaining means for retaining the item and may also comprise a biasing means to bias the retaining element as described herein. In some embodiments the biasing means of the retaining element, is a biasing mass.

It is convenient for the inner retaining element to comprise a means for access to the interior of the element, for the purpose of placing the item, the retaining means or a biasing mass. Conveniently this can be in the form of a cap or seal to the inner retaining element or the retaining element can be formed of two or more separable parts. The retaining element may be hollow, which saves weight and materials, but also allows easier access to the interior for access to retaining means that may be situated there. Conveniently the retaining means may be formed of two or more separable parts to provide access to the interior.

In one embodiment, the retaining element is of generally spherical form. This provides a simple design, and enables the retaining element to rotate about all axes freely. A hollow spherical form saves weight and therefore allows a lower mass to bias its orientation, and is therefore preferred. A spherical form conveniently also allows the retaining means to be retained and/or constrained by a spherical surface of the housing element, thereby limiting lateral or radial movement. A complete spherical surface is not necessarily needed to achieve this. The retaining element may also be constrained by a sufficient part of a spherical surface to constrain the retaining element, whereby the spherical surface of the outer housing constrains the spherical retaining element, but does not completely surround it. This allows free access to a portion of the retaining element, where a retaining means may be situated, to provide access to the item. Ovoid forms provide a similar advantage.

In one embodiment, a mass separate to the item may be provided. The mass may be provided such as to orient the retaining element in order to present the retaining means and therefore the item, towards the top of the retaining means, or it may be provided such as to orient the retaining element in order to present the retaining means and therefore the item, towards the bottom of the retaining means. If the retaining means is provided at the bottom of the sphere, i.e. in relation to the mass, then this has the advantage that the item may be protected within the retaining element. If the retaining means is provided at the top of the sphere relative to the mass, then the item is presented with easier access for removal.

If the item has sufficient mass to bias the retaining element on its own, then the retaining means will become positioned towards the bottom of the sphere, oriented such that the mass of the item biases the item into the preferred orientation. This embodiment is particularly useful when the item to be retained is, for example, a radioactive source held in a heavy (e.g. lead) shielding container.

The retaining element may be filled, such as with a lightweight material, e.g. expanded polyurethane foam, which serves to improve rigidity and provide additional protection to the item.

In one embodiment, the spherical retaining element is in the form of a cage defining the outer surface of the sphere, or a sufficient part thereof to be retained and/or constrained by a housing element as described herein, particularly where the housing element has a spherical surface, or sufficient thereof to retain and/or constrain the retaining element. The cage comprises the retaining means and, where present, the biasing mass, both of which are as described further herein. This approach provides a further weight and or material saving, and improves access to the retaining means. Typically the outer surface of such a cage will be curved to match the inner surface of the housing element, in both circumference and width. The outer edges of the cage elements may be raised away from the inner surface of the housing in order to aid smoother rotation.

In one embodiment, the retaining element comprises a ring adapted to be retained within a spherical space and constrained radially in all directions by the housing element. Typically the outer surface of such a ring will be curved to match the inner surface of the housing element, in both circumference and width. Thus the outer face of the retaining element comprises a curved surface having a curvature matching that of the inner surface of the housing element, such that the retaining element is constrained radially and laterally by the surface. The retaining element is still able to rotate within the housing. The width of the ring band will be sufficient to ensure that the ring is constrained radially within the space, in order to prevent the ring becoming dislodged. Typically a ring will describe the outer surface of a spherical segment, formed from parallel planes either side of the centre of the sphere, and of sufficient width such that it is constrained by the surface. The effect may equally be achieved by a ring comprising constraining means (such as, optionally resilient, rollers as described herein), adapted to act against the spherical surface and limit lateral or radial movement, in which case the ring band need not be curved across its width to match the inner surface of the housing. In order to prevent the edges of the ring catching on the inner surface, the edges of the ring band may be raised away from the surface, such as in a curve.

In a further embodiment the retaining element comprises, a network of supports supporting a retaining means, which may be reversibly detachable, and, where present, the biasing mass, which may also be reversibly detachable. This network provides a weight saving advantage. The individual supports typically mutually interconnect at a point, usually centrally, and form 2, 3, 4, 5, 6, or more arms extending to the inner surface of the housing. The arms may be adjustable in length which has the advantage of allowing one retaining element to be used in a variety of sizes or types of housing element, or to take account of a variety of sizes of retaining means to retain a variety of sizes of item. Length adjustment may be achieved automatically if the arms are resiliently extendable, for example by spring loaded telescopic elements; this also helps to maintain contact between the arm and the surface.

The provision of load spreading means, such as pads and/or friction reducing means at the point where the arm impinges on the surface, (i.e. at the ends of the arms) improves ease of movement. Particularly, the use of friction reducing means such as bearings or rollers as described herein for other embodiments, allows adjustable components of the framework to adapt for use in a variety of sized outer supports.

It is further contemplated that any retaining element may additionally comprise handling means, such as finger holds, typically as indentations or holes, sized to act as finger holds, that allow easy gripping or handling of the retaining element. This is especially useful if the retaining element is spherical, or other shape that is hard to grip.

The retaining element is adapted to releasably retain the item to be transported. This is typically achieved by the provision of a retaining means that securely retains the item and optionally correctly orienting the item. Typically the retaining means holds the item within the retaining element; if the retaining means does not extend beyond the boundary of the retaining element then this ensures a free movement of the retaining element within the housing. The retaining means is positioned and oriented relative to the biasing mass such that the turning moment of the biasing mass tending to its lowest point, holds the retaining means and the item in the preferred, or first, orientation, or returns it this orientation once rotationally displaced.

Although reference is made to a single retaining means, it is contemplated that each container or package may comprise several retaining means for retaining one or more items. Thus a retaining element may comprise one, two, three or more retaining means for retaining items.

The retaining means may be fixed to (i.e. not detachable from) the retaining element, but may be reversibly detachable from the retaining element, allowing awkwardly shaped items to be installed before the retaining means is re attached to the retaining element, for example. Either, or both, of the biasing mass and the retaining means may be reversibly detachable, through the use of a variety of fixing means known in the art, including clips, catches, threads, interference fittings, Velcro®-type fixings and so on, allowing appropriate biasing masses and retaining means to be fitted to a retaining element and thus accommodate a variety of items. Indeed, the retaining means may simply be a fixing adapted to fix the item to the retaining means. In a further embodiment the retaining means incorporates the biasing mass, optionally in a reversibly detachable manner.

The retaining means may, for example, comprise, a receptacle of suitable size to hold the item and adapted to retain the item in place, for example the receptacle may have an opening closable by a closure means, such as a hinged or removable cap, to prevent the item becoming dislodged. The receptacle is adapted to maintain the item in the preferred orientation, when the biasing mass positions the retaining element with the biasing mass at the bottom. The receptacle may be positioned such that the opening opens to the inside of the retaining element or to the outside of the retaining element. If the closure means opens to the outside of the retaining element, then, it is preferred that the outer surface of the closure means is contiguous with the outer surface of the retaining element. This provides a smoother surface and easier rotation. If the receptacle opens to the inside of the retaining element then a means for accessing the inside of the retaining element is typically required, such that the item can be placed and retrieved. Conveniently in this embodiment the retaining element will be hollow, and the interior can be accessed as described elsewhere herein. In a particular embodiment the receptacle fixed to the retaining element, opens to the outside of the retaining element and is preferably closed, by a closure means, such as a hinged or removable cap. The closure means optionally provides the biasing mass, providing a simple arrangement biasing the item to the bottom of the retaining element relative to the outer housing element.

In one preferred embodiment, the retaining means comprises, or is formed from, two, three or more sheets, co-operating to form one or more retaining voids adapted to retain an item and optionally, to form one or more biasing mass holding means for holding a biasing mass. In this embodiment, the retaining means is typically adapted to be reversibly demountable from the retaining element, and is particularly suitable for use with a retaining element that is hollow, such as a hollow sphere. Preferably the individual sheets are connected by a hinge portion, which allows the retaining means to be made in one piece and allows for easy folding and positioning of the individual parts with respect to each other. Preferably the sheets are held adpressed to one another and thereby the retaining means is held closed to retain the items, using one or more closure means. Conveniently these closure means can be formed as part of the sheets, and for example, take the form of a button or protrusion from the surface of one sheet that clips into a depression formed on the surface of the opposite sheet to hold the two together. In a simple and cheap alternative, the sheets can simply be stapled together. The retaining means is adapted to be held in place within the retaining element, and attached to it such that it rotates with the retaining element, such as by adapting its size and shape to fit the inner surface of a hollow retaining element. In one approach the outer boundaries of the sheets are shaped to form lips, preferably extending around the whole periphery, which engage with the inner surface of the hollow retaining element. Typically the holding means to retain the biasing mass are one or more holding voids adapted to retain a biasing mass.

A preferred outer housing element is provided such that it supports the inner retaining element. If the retaining element is also constrained by the housing element, whilst still allowing rotation of the retaining element, then a more secure packaging is provided. In some embodiments it is advantageous for the retaining element to be constrained in all directions by the housing element, whilst allowing rotation of the retaining element within the housing.

The housing and the retaining elements each preferably have a vertical axis, the retaining element being freely rotatable such that its vertical axis is displaceable up to at least 90 degrees from the vertical axis of the housing element, more preferably at least 180 degrees to the vertical axis of the housing element and most preferably 360 degrees to the vertical axis of the housing element. Preferably the retaining element has vertical and horizontal axes of symmetry and can freely rotate at least 180 degrees about its vertical and horizontal axes of symmetry and more preferably can rotate 360 degrees about its vertical and horizontal axes of symmetry, within the housing.

It is preferred that the retaining element is free to rotate, about one, two, three or more, or any, or all axes of symmetry. In this way the orientation of the packaged item retained by the retaining element can be maintained regardless of the direction of rotation of the outer housing element. In such embodiments, it is advantageous for the retaining element to be free to rotate about any axis of symmetry, whist retained, supported or constrained radially, by the housing. The housing element acts to retain or hold the retaining element whilst allowing the retaining element to rotate independently of the housing element about at least one axis.

It is contemplated that a housing element may retain one, two, three or more of any inner retaining element described herein.

Where the retaining element is free to rotate, it is preferred that it is constrained in all directions radially from the, or any, rotational axis, by the outer housing in order to prevent the retaining element moving radially, whilst still allowing the retaining element to rotate independently of the housing. This has the advantage of more firmly retaining the retaining element. Where the retaining element is spherical, it is preferred that it is constrained in all directions radially from the centre.

In one embodiment the outer housing comprises a retaining or constraining surface. The retaining element is free to rotate, within the outer housing, whilst retained or constrained by the surface. The surface typically defines a space within which the retaining element is free to rotate. The surface may comprise constraining means adapted to constrain the retaining element. Suitable constraining means may be protrusions from the surface, or rollers or bearings, which act to constrain the retaining element, or they may be resilient means that constrain the retaining element, but also isolate it from shock. Suitable resilient means may be, for example resilient protrusions or resiliently (such as by springs) mounted rollers or bearings. It is understood that a similar end can be achieved if the retaining element comprises such protrusions and/or resilient means that act against the surface, or if both the retaining element and the surface comprise these means.

Constraining means described above are particularly useful when the retaining element is of a spherical shape as they can act to constrain the inner frame work in all directions radially, whilst providing less frictional area between the retaining element and housing.

Preferably the surface is a spherical surface or a sufficient portion thereof to retain the retaining element, and/or to constrain the retaining element as described herein. This approach is particularly preferred when the retaining element is of a spherical form, or other shape suitable to be retained or constrained by a spherical surface, or part thereof, such as an ovoid.

In one embodiment the housing consists of two or more parts, that cooperate to retain and/or constrain the retaining element. Particularly, the parts co-operate to define the space, bounded by the surface. Two three four or more such sub-assemblies are envisaged and this provides easy manipulation of the retaining element and provide access to the retaining means and to the item retained therein. The housing may be solid or hollow in order to save weight and or materials, or may comprise a network of support members that provide the required features. In one arrangement the outer housing is a solid or hollow moulding, of 2 or more parts co-operating to define the space and retaining surface.

In a further embodiment, the housing element is a hollow sphere, preferably of two or more separable parts, co-operating to form the sphere. The retaining element rotates freely within the sphere, optionally constrained by the inner surface. The packaging unit or container of the invention may then comprise a second outer housing, retaining the spherical housing, preferably holding it immobile.

Both retaining element and housing can be fabricated from a variety of materials, according to cost, durability and so on. A variety of plastics, or metals are appropriate and can be selected according to requirement.

Where a retaining element is retained or constrained by the outer housing element, but is required to be free to move within the housing, it may be advantageous to provide means for reducing the frictional forces between the retaining element and the housing. This can be achieved in a number of ways. It is contemplated that a lubricant be used between contact surfaces between the retaining element and the housing, or that one or more of these surfaces are coated with or otherwise comprise a low friction material, such as Teflon® (polytetrafluoroethylene). It is further contemplated that either the retaining element or the housing or both, comprise protrusions, resilient protrusions, or other resilient means as described herein, that allow the retaining element to be constrained within the housing with protection against vibration, whist still allowing the retaining element to move independently of the housing element. Good freedom of motion can also be achieved by using microspheres interposed between the retaining element and housing. These may be for example ceramic microspheres and may be, for example, 100 to 1000 microns in diameter.

Typically, packages for transport will comprise the packaging unit of the invention and a removable outer packaging envelope which covers and protects the packaging unit. The outer envelope typically completely covers the packaging unit and is formed as a box, crate, cage or other protective covering. The outer envelope will typically be formed of materials usual in the art, such as cardboard, wood, metal or plastic depending on considerations such as the degree of protection, cost, reusability, recyclability and so on.

Within the scope of the invention, a number of further embodiments are contemplated. These embodiments may also comprise additional features or embodiments described herein. For example, the invention further provides a container or transport packaging unit comprising a) an inner spherical retaining element comprising a retaining means for retaining an item requiring orientation control, and a mass acting to maintain the item in a preferred orientation, and b) an outer housing element, the retaining element retained within the housing element, free to rotate within the housing element.

The invention also provides a container or transport packaging unit comprising a) an inner retaining element comprising a retaining means for retaining a packaged item, and a mass acting to maintain the packaged item in a preferred orientation, and b) an outer housing element, the outer housing element comprising a surface, the inner retaining element free to rotate within the outer housing element whist constrained radially by the surface.

In a further embodiment, the invention provides a container or a transport packaging unit for containing or transporting a radioactive source in a preferred (preferably upright) orientation, the packaging unit comprising a) an inner retaining element, and b) an outer housing element, the inner retaining element retained within the housing element and free to rotate about all axes of symmetry and comprising a retaining means for retaining a (preferably shielded) radioactive source, the retaining means arranged such that the mass of the (preferably shielded) radioactive source, when held in the retaining means, biases the retaining element such that the radioactive source is maintained in a preferred (preferably upright) orientation.

Where the transport packaging unit or container of the invention does not comprise a biasing mass, the invention provides a container or transport packaging unit comprising an inner retaining element comprising a retaining means for retaining an item requiring orientation control, and an outer housing element, the retaining element retained within the housing element and free to rotate.

Furthermore, it is also contemplated that containers and transport packaging units of the invention would be provided without a retaining means, in order that the retaining means and biasing mass may be selected as appropriate and so the invention also provides a container or transport packaging unit comprising an inner retaining element and an outer housing element, the retaining element retained within the housing element and free to rotate.

In such embodiments, the retaining element may be provided with means for attaching a biasing mass and/or a retaining means, such as an adhesive means (e.g. a pre-placed contact adhesive), a Velcro®-type fastening, a clip or catch a screw thread or any other appropriate fastening. Such means may be appropriate for releasable attachment or permanent attachment. The means for attaching the retaining means (or the retaining means if present) is positioned and/or oriented relative to the means to attach the biasing mass (or the biasing mass if present) such that the turning moment of the attached biasing mass tending to its lowest point, holds any attached retaining means in the preferred position and/or orientation to maintain the item in its preferred orientation.

The biasing mass may be provided separately or as part of a kit as described herein, and the invention also encompasses the provision of such biasing masses as separate items of commerce. The biasing mass may be adapted for compatibility with the retaining means, such as by being appropriately shaped to be attached thereto. It may also be of an appropriate mass to bias a retaining means and selected item and may be adapted to be attached reversibly or otherwise to the retaining element. Particularly, such biasing masses may comprise a means for attaching the mass to the retaining means, such as an adhesive means (e.g. a pre-placed contact adhesive), a Velcro®-type fastening, a clip or catch, a screw thread or any other appropriate fastening. Thus the invention also contemplates a biasing mass for a container or transport packaging unit as described herein comprising a body having a mass sufficient to bias a retaining element as described herein, the body adapted for attachment to the retaining element.

The retaining means may also be provided separately, or as part of a kit. The invention therefore also provides a retaining means for a container or transport packaging unit as described herein, comprising a means for securely retaining an item and adapted for attachment to a retaining element as described herein.

The invention also provides a kit for packaging an item or containing an item, comprising a container or packaging unit as described herein and one or more biasing masses and/or retaining means as described herein. Such kits may comprise a plurality of biasing masses of different masses and/or a plurality of retaining means of various sizes or configurations Containers of the invention are also suited to rail, road, air or water vessel transportation in 'containerised' format. The invention therefore also contemplates a container for transportation in containerised format comprising an outer housing element in the form of a rigid enclosure, an inner retaining element supported within the outer housing element and free to rotate about an axis, the retaining element comprising a container for bulk material and comprising a body of sufficient mass to bias the retaining element and the container to maintain the container upright and positioned to maintain the container upright whatever the orientation of the outer framework about the axis.

Typically such containers will have a longitudinal axis that is of greater dimension than its height and width. In such containers the retaining element will be free to rotate about the horizontal axis. The retaining element will typically comprise one or more containers for bulk material, which preferably have an access in their upper surface, sealed with a closure.

In this manner liquid or particulate container contents remain in an upright position and do not directly contact the sealed access opening, for example, should the container roll over, about its longitudinal axis in a collision. The retaining element and container take up a position with any upper access opening located on the upper surface with respect to gravity.

The invention also contemplates a container for securely mounting hazardous material such as radioactive, chemically reactive, biologically active or poisonous material during handling. Such containers are particularly useful when operatives are dressed in protective clothing or are using robot manipulators, which make handling more cumbersome. The invention therefore provides a container comprising an outer housing element in the form of a base element supporting an inner retaining element, the retaining element comprising a retaining means for mounting a hazardous material and a biasing mass, the inner retaining element free to rotate within the housing element, the biasing mass being sufficient to return the retaining element to the upright position following (rotational) displacement.

Such an arrangement is particularly useful for working with open vessels in order that the opening of the vessel remains oriented upright with respect to gravity. In this embodiment it is particularly preferred that the retaining means mounts the material in the upper portion of the retaining element, such that it is not enclosed by the outer housing. It is preferred that the retaining element is a spherical or ovoid shape. It is also preferred that the outer housing constrains the retaining element in a manner described herein, such that it is constrained radially but remains free to rotate. In this way the retaining element cannot be displaced from the outer housing during use.

The containers and transport packaging units of the invention find utility in a variety of areas such as the transport or packaging of hazardous or delicate materials. Examples include radioactive sources, particularly when shielded in heavy shielding (including fluids particulates and suspensions), art works, plants and sensitive electronics.

The present invention will now be described further with reference to the following non limiting examples schemes and figures. Further embodiments falling within the scope of the invention will occur to those skilled in the art in the light of these.

FIGURES

Figure 1B:
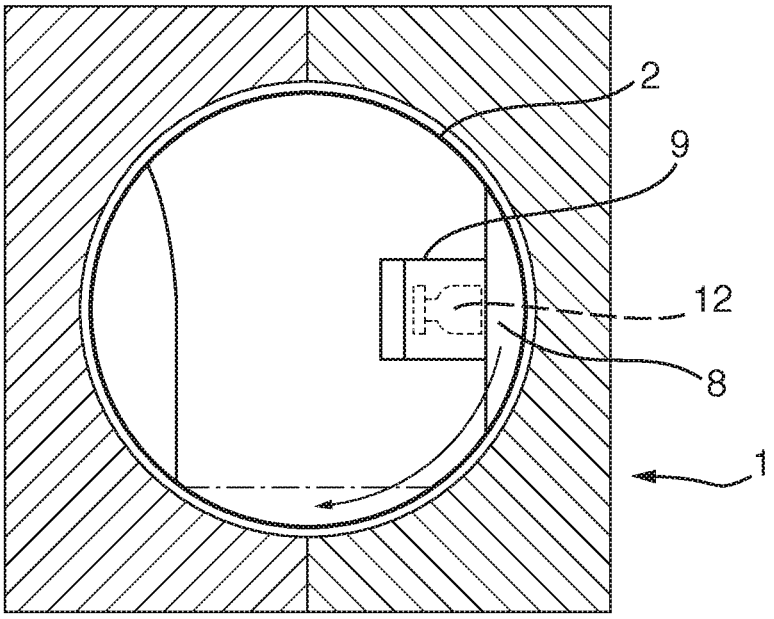

FIG. 1. shows a packaging unit of the invention. FIG. 1(*a*) shows the unit at rest. FIG. 1(*b*) shows the unit turned on its side and illustrates the tendency of the inner retaining element to maintain its preferred orientation following rotational displacement of the outer housing.

Figure 2A:
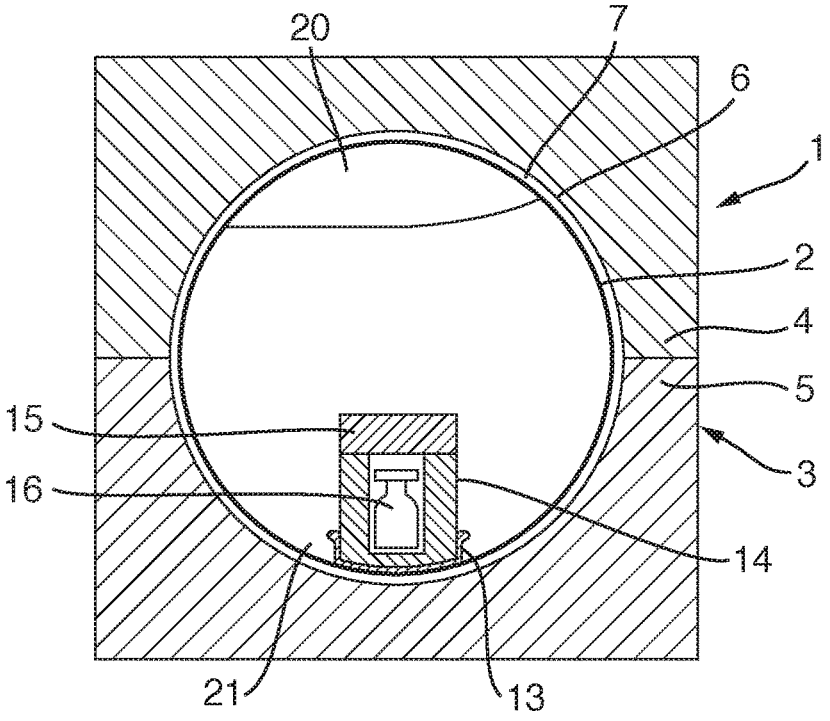
Figure 2B:
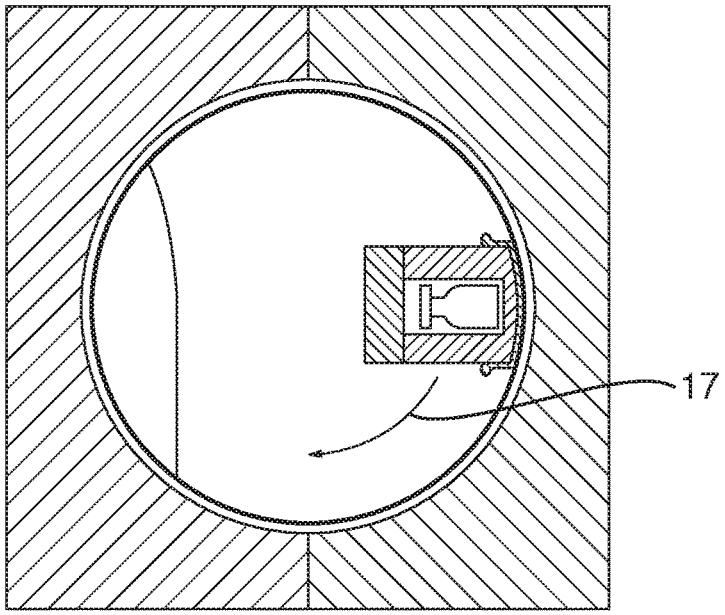

FIG. 2. illustrates an alternative embodiment in which the mass of the item to be transported is sufficient to bias the inner retaining element to the preferred orientation.

Figure 3A:
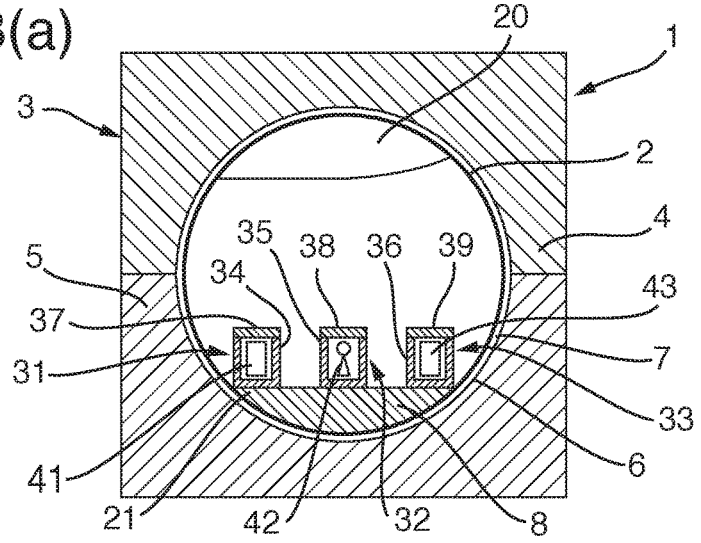
Figure 3B:
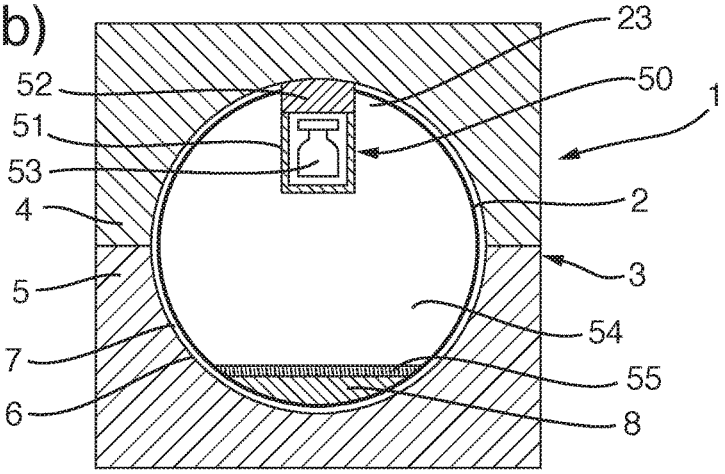
Figure 3C:
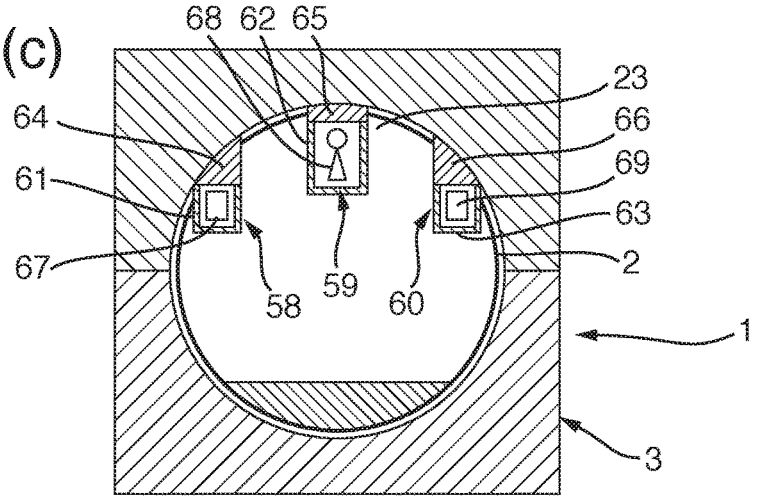

FIG. 3. illustrates alternative embodiments of the invention. FIG. 3(*a*) illustrates and embodiment having multiple retaining means. FIG. 3(*b*) illustrates an embodiment in which the biasing mass counter balances the retaining means into a position at the top of the retaining element. FIG. 3(*c*) illustrates a further embodiment having multiple retaining means.

Figure 4A:
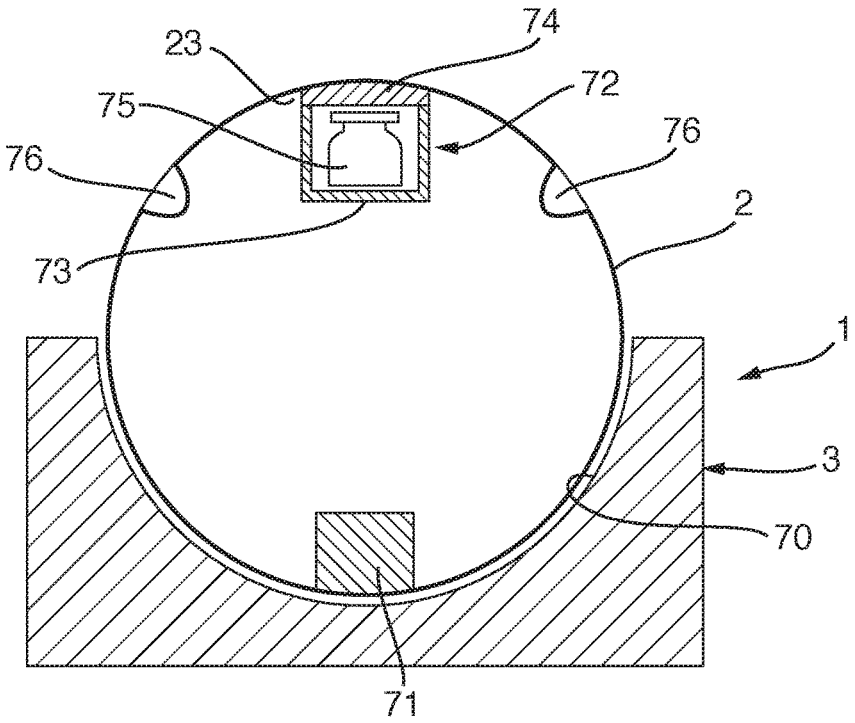
Figure 4B:
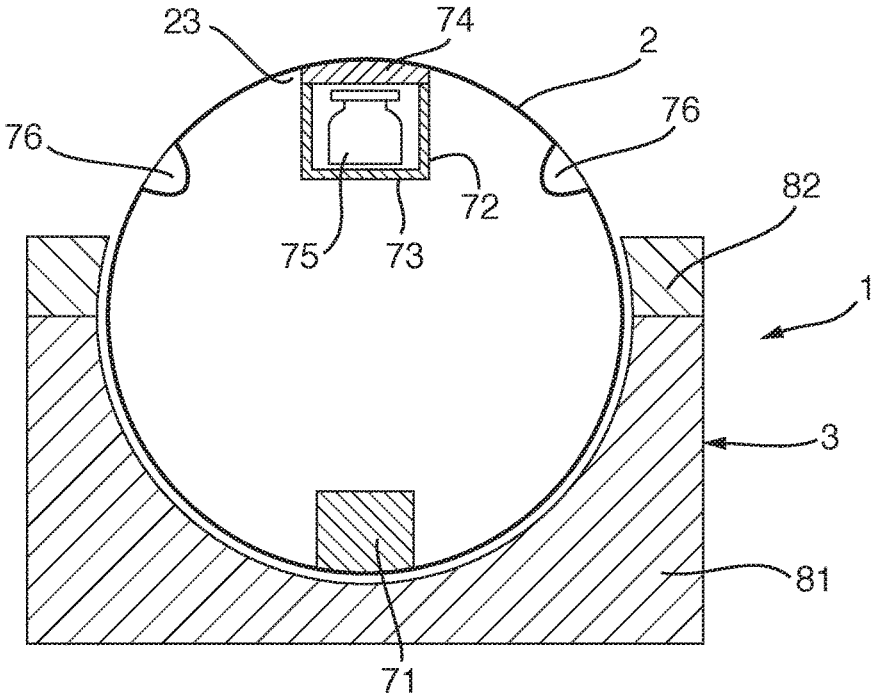
Figure 5A:
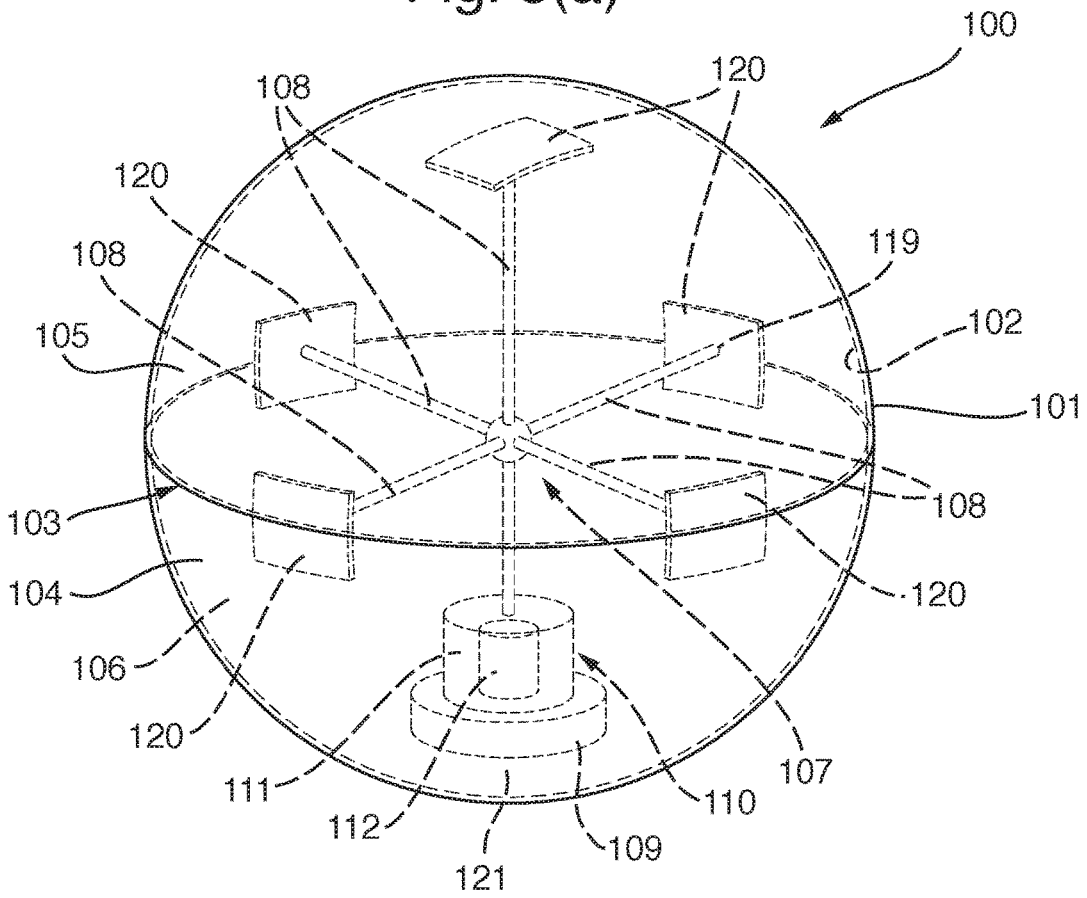
Figure 5B:
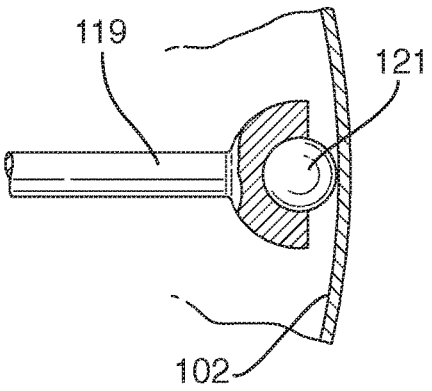
Figure 5C:
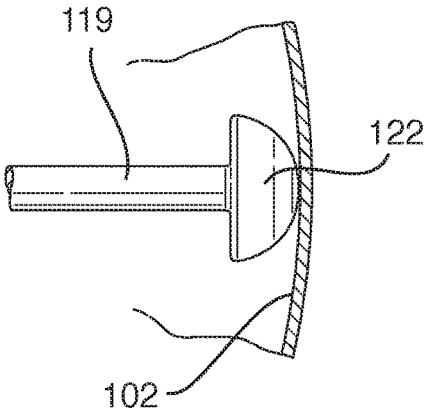
Figure 5D:
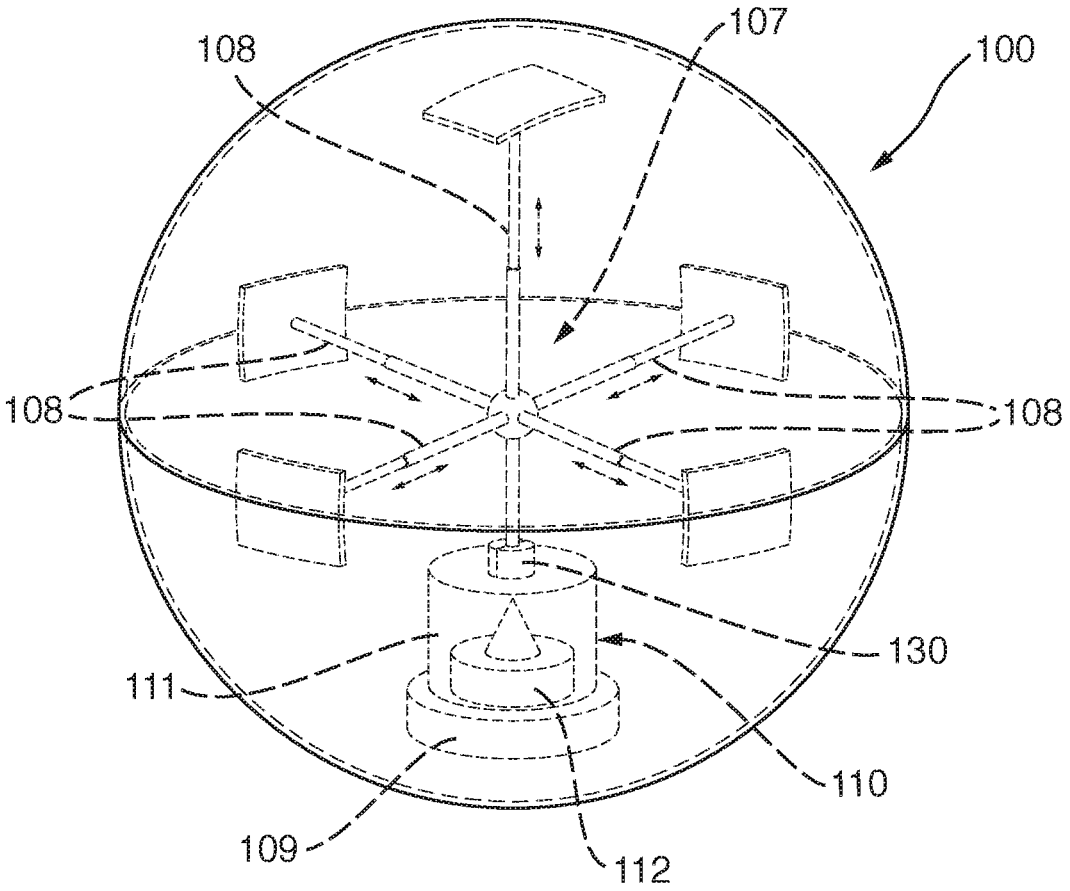

FIGS. 4. (*a*) and (*b*) illustrate embodiments in which the retaining means are biased to the top of the retaining element. In FIG. 4(*a*) the retaining means is unconstrained, in FIG. 4(*b*) the retaining means is incompletely covered, but is constrained by the housing.

FIG. 5(*a*) illustrates a retaining means formed from a network of supports retained within a hollow spherical housing element. FIGS. 5(*b*) and (*c*) illustrate alternative terminations for the support elements. FIG. 5(*d*) illustrates a retaining means formed from a network of adjustable supports retained within a spherical housing element FIG. 6. illustrates a bulk transport container embodying the invention.

FIG. 7. illustrates a retaining element having a retaining means formed from a plurality of sheet elements. FIG. 7(*a*) shows a general view of the embodiment.

FIG. 7(*b*) illustrates a retaining means suitable for retaining a plant for transport, without an additional biasing mass. FIG. 7(*c*) illustrates a similar embodiment with provision for adding a biasing mass. FIG. 7(*d*) illustrates a cross section of a clip holding the two laminae together. FIGS. 7(*e*) and 7(*f*) are side views of the retaining means of FIGS. 7(*b*) and 7(*c*) respectively. FIG. 7(*g*) is a further embodiment of the plant retaining means and FIG. 7(*h*) illustrates an embodiment of a retaining element suitable for use with this retaining means.

Figure 8:
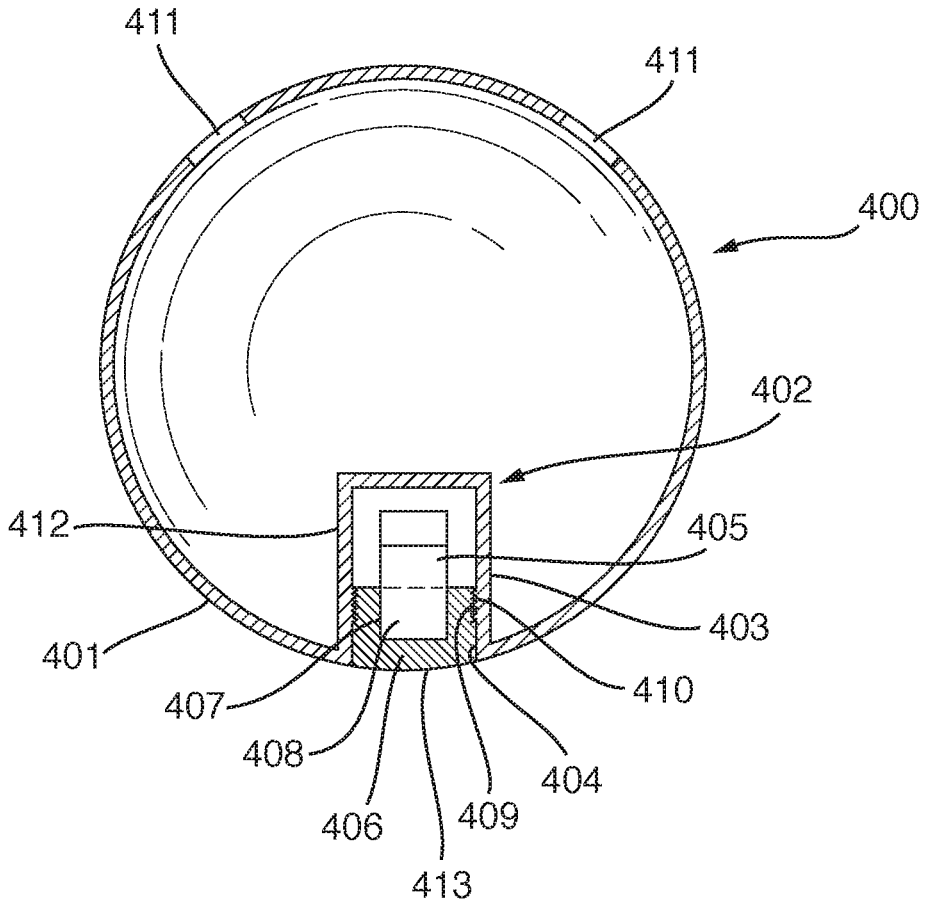
Figure 9A:
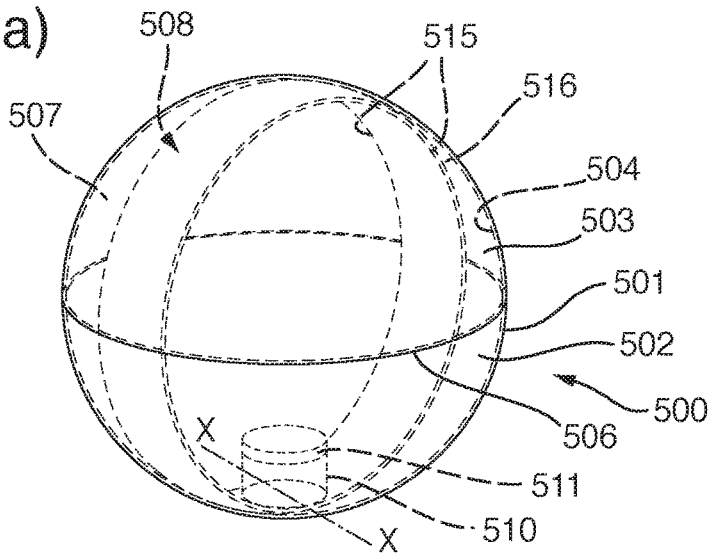
Figure 9B:
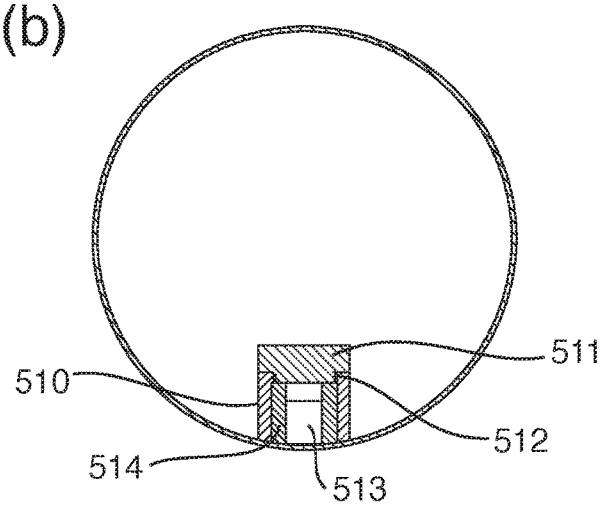
Figure 9C:
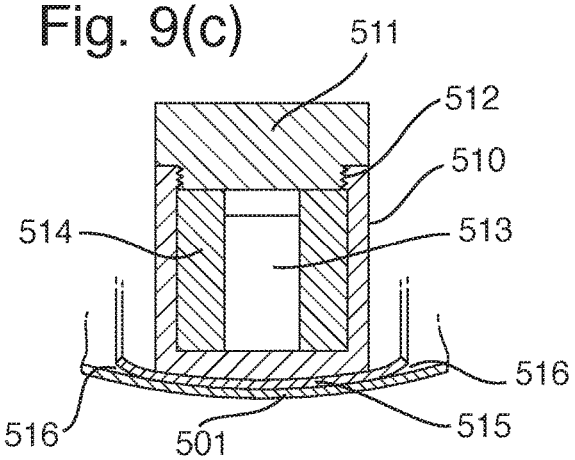
Figure 9D:
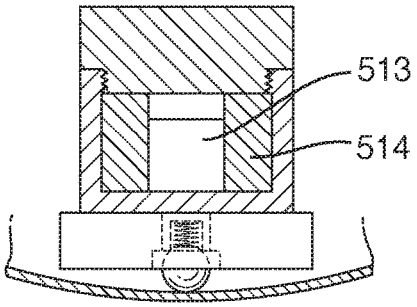

FIG. 8. is a cross section of a further embodiment of a spherical retaining element.

FIG. 9 shows an embodiment of the invention in which the retaining element is ring shaped.

FIG. 1

FIG. 1(*a*) illustrates a simple packaging unit of the invention (1) in cross section. A spherical shaped inner retaining element (2) is supported within a solid outer housing (3) made up of two parts (4) and (5) which co-operate to form a spherical surface (6) bounding a spherical space (7) within which the retaining element is free to rotate. The turning moment of a biasing mass (8) acts to orient the retaining element with the biasing mass at the bottom. A retaining means (9) in the form of a receptacle (10) with a cap (11) is situated inside the spherical retaining element towards the bottom of the sphere (21) and attached to it. The receptacle retains an item whose orientation is required to be controlled during transit (12). The spherical retaining element (2) comprises a removable cap portion (20) to provide access to the retaining means.

If the orientation of the packaging unit (1) is disturbed during transit (FIG. 1(*b*)) then the turning moment of the mass (8) acts to maintain the item in its starting orientation by causing the inner retaining element (2) to rotate relative to the outer housing (3).

FIG. 2

FIG. 2 illustrates an alternate form of the container/packaging unit. FIG. 2(*a*) shows a packaging unit (1) having a spherical shaped inner retaining element (2) supported within an outer housing (3) as per FIG. 1. The outer housing is made up of two parts (4) and (5) which co-operate to form a spherical surface (6) bounding a spherical space (7) within which the inner spherical retaining element (2) is free to rotate. A retaining means in the form of a clip (13) attached to the inner surface of the retaining element towards the bottom of the sphere (21) releasably holds a heavy container (14), which is closed with a lid (15). If the orientation of the packaging unit is disturbed during transit (FIG. 2(*b*)), the turning moment of the heavy container (17) is sufficient to bias the vial to its original orientation. Additional biasing mass is not required.

FIG. 3

FIG. 3 illustrates several arrangements of biasing mass and retaining means. FIG. 3(*a*) illustrates a packaging unit of the invention (1). A spherical shaped inner retaining element (2) is supported within an outer housing (3) made up of two parts (4) and (5) which co-operate to form a spherical surface (6) bounding a spherical space (7) within which the retaining element is free to rotate. A biasing mass (8) acts to orient the retaining element with the biasing mass at the bottom. A plurality of retaining means (31. 32, 33) in the form of receptacles (34, 35, 36) with lids (37, 38, 39) are situated within the inner retaining element towards the bottom of the sphere (21) and attached to it, each of which retains an item (41, 42, 43) whose orientation is required to be controlled during transit. The inner spherical retaining element comprises a removable cap portion (20) to provide access to these retaining means.

In FIG. 3(*b*) a packaging unit of the invention (1) comprises a spherical shaped inner retaining element (2) as per FIG. 1, supported within an outer housing (3) made up of two parts (4) and (5) which co-operate to form a spherical surface (6) bounding a spherical space (7) within which the retaining element is free to rotate. A biasing mass (8) acts to orient the retaining element with the biasing mass at the bottom. A retaining means (50) in the form of a receptacle (51) attached to the retaining element and having a lid (52) is situated within the retaining element towards the top of the sphere (22), diametrically opposite the biasing mass. The receptacle retains an item whose orientation is required to be controlled during transit (53). The interior of the sphere (54) is hollow to save weight. The biasing mass (8) is removably attached e.g. by a screw tread (55) so that the weight can be adapted to maintain the orientation of a variety of weights of item (53).

In FIG. 3(*c*) a packaging unit of the invention (1) comprises a spherical shaped retaining element (2) which comprises a plurality of retaining means (58, 59, 60) in the form of a receptacles (61, 62, 63) with caps (64, 65, 66) situated within the retaining element towards the top of the sphere (23) each retains an item whose orientation is required to be controlled during transit (67, 68, 69).

FIG. 4

FIG. 4 illustrates a container or packaging unit (1) of the invention. In FIG. 4(*a*) a spherical shaped inner retaining element (2) is supported within a solid outer housing (3) having a partially spherical surface (70) which supports the retaining element, but allows it to rotate. The retaining element (2) is partially exposed. and is not constrained in all directions. A biasing mass (71) acts to orient the retaining element with the biasing mass at the bottom and hence maintains the orientation of the retaining means (72) and the retained item (75). The retaining means is in the form of a receptacle (73) with a lid (74) and is situated within the retaining means towards the top of the sphere (23). The retaining element (2) comprises handling means (finger holes—76) which allow for ease of handling of the retaining means. The retaining element is not constrained by the housing, but is supported by it.

If the orientation is disturbed, such as during transit then the turning moment of the mass (71) acts to maintain the item in its starting orientation, but if the orientation is radically altered the retaining element will be released, malorienting the packaged item. Arrangements in which the retaining element are not retained are therefore less suitable for transit packaging but useful for containers during storage and use, to prevent tipping of the item and loss of contents.

FIG. 4(*b*) illustrates an further form of the container or packaging unit (1) of the invention. A spherical shaped retaining element (2) is supported within an outer housing (3) which comprises 2 sub-assemblies (81 and 81) which cooperate to provide a partially spherical surface (70) which supports the retaining element and constrains it in all directions, whilst allowing it to rotate. A biasing mass (71) acts to orient the retaining element with the biasing mass at the bottom and hence maintains the orientation of the retaining means (72) and the retained item (75). The retaining means is in the form of a receptacle (73) with a lid (74), attached to the retaining element and situated within the retaining element towards the top of the sphere (23). The retaining element (2) comprises handling means (finger holes (76)) which allow for ease of handling of the retaining element. This arrangement still allows easy access to the retaining element and the contained item, saves weight and maintains the orientation of the item regardless of the rotation of the packaging unit. The arrangement is also suitable for holding items during storage or use and may be used to hold hazardous materials during manipulation.

FIG. 5

FIG. 5(*a*) shows a packaging unit (100) comprising a spherical outer housing element (101) having a spherical inner surface (102). The housing is made up of two sub-assemblies, (104 and 105) which co-operate to form the spherical inner surface and allow the sphere to be split at (103) for access to the hollow interior space (106). A retaining element (107) comprising a network of supports (108), supporting a biasing mass (109) and a retaining means (110) in the form of a receptacle (111) retaining an item (112) whose orientation is to be maintained during transit. The terminal portion of the supports (119) comprise a load spreading portion (120) which reduces friction and helps the retaining element to rotate freely.

FIGS. 5(*b*) and 5(*c*) show alternative arrangements for embodiments in which the retaining element comprises a network of supports. In FIG. 5(*b*) the ends of the supports (119), have a captive bearing (121) that runs against the inner spherical surface (102); whilst in FIG. 5(*c*) the support ends have a mushroom shaped end (122). Both variants shown in FIGS. 5(*b*) and 5(*c*) are particularly suitable for use with embodiments such as that illustrated in FIG. 5(*d*), in which the supports are adjustable for length to take account of various sizes of outer support.

In FIG. 5(*d*) the packaging unit (100) of FIG. 5(*a*) comprises an inner retaining element (107) comprising a network of supports (108), supporting a biasing mass (109) and a retaining means (110) in the form of a receptacle (111) retaining an item (112) whose orientation is to be maintained during transit. The supports (108) are adjustable for length, so as to take account of various possible sizes of outer support, and to hold the supports firmly against the inner surface. The terminal portion of the supports (119) comprise a load spreading portion (120) which reduces friction and helps the inner retaining to rotate freely, but these may be substituted with the support ends illustrated in FIGS. 5(*b*) and 5(*c*).

The network of supports includes a quick release mechanism (130) which allows different retaining means (110) to be used as appropriate for each item (112).

FIG. 6

Figure 6A:
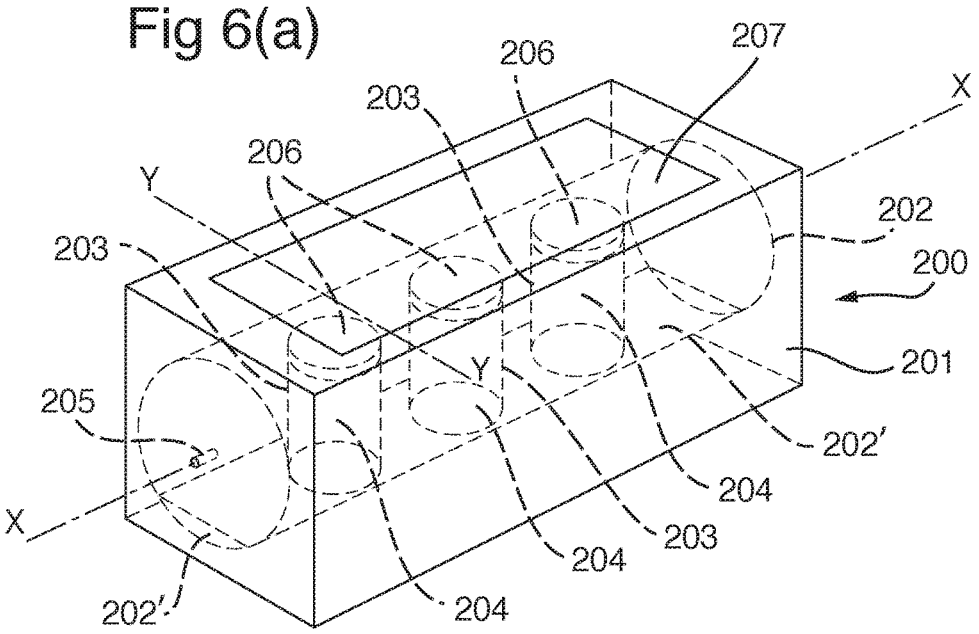
Figure 6B:
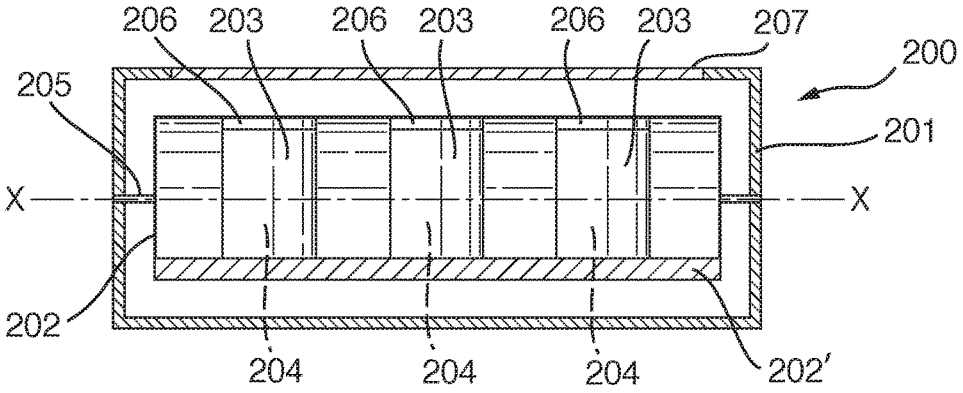
Figure 6C:
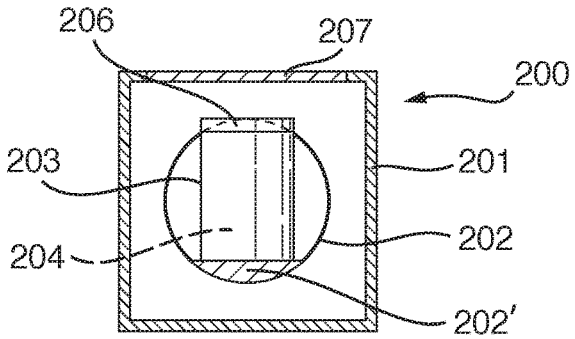
Figure 7A:
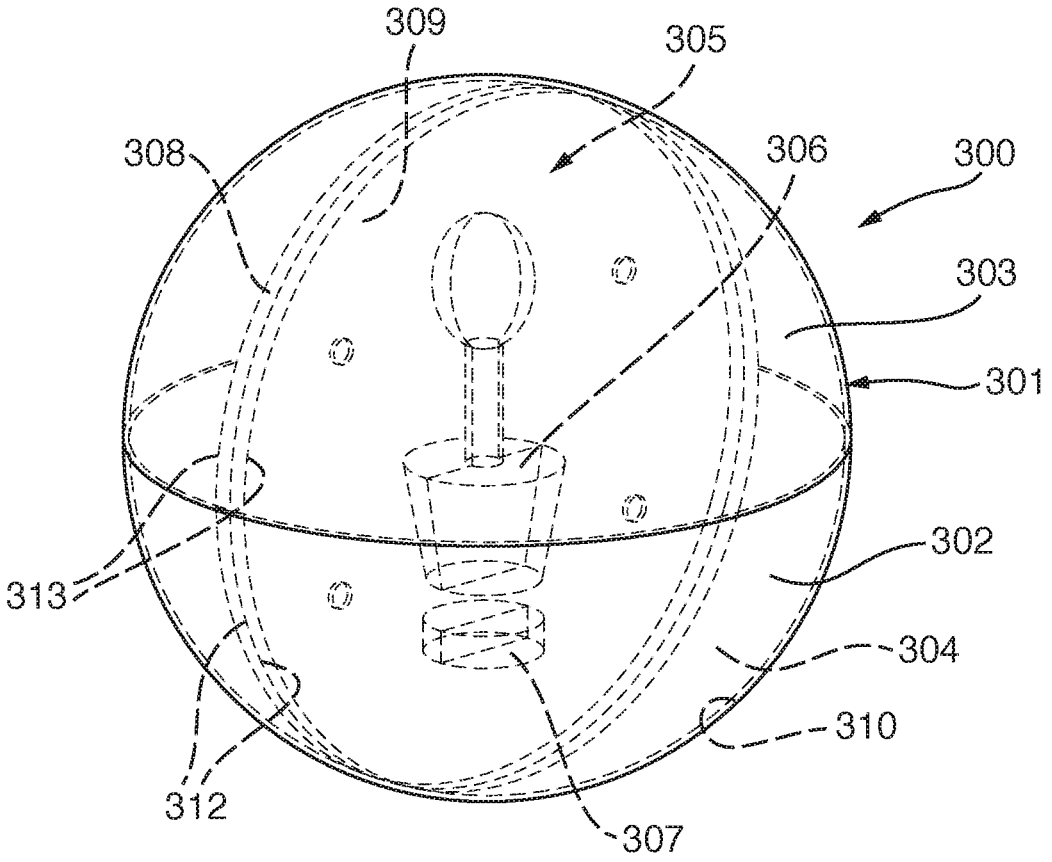
Figure 7B:
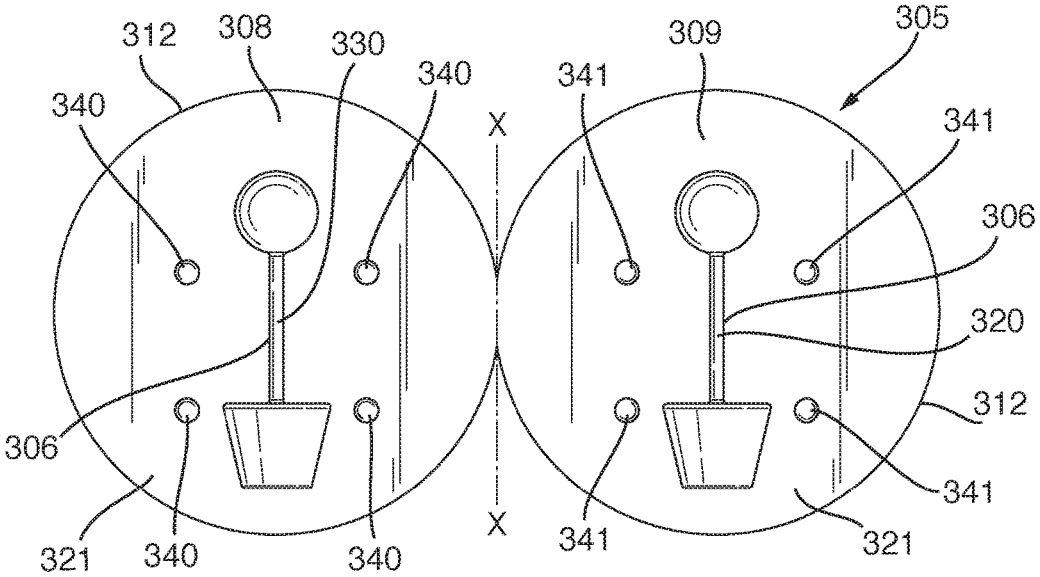
Figure 7C:
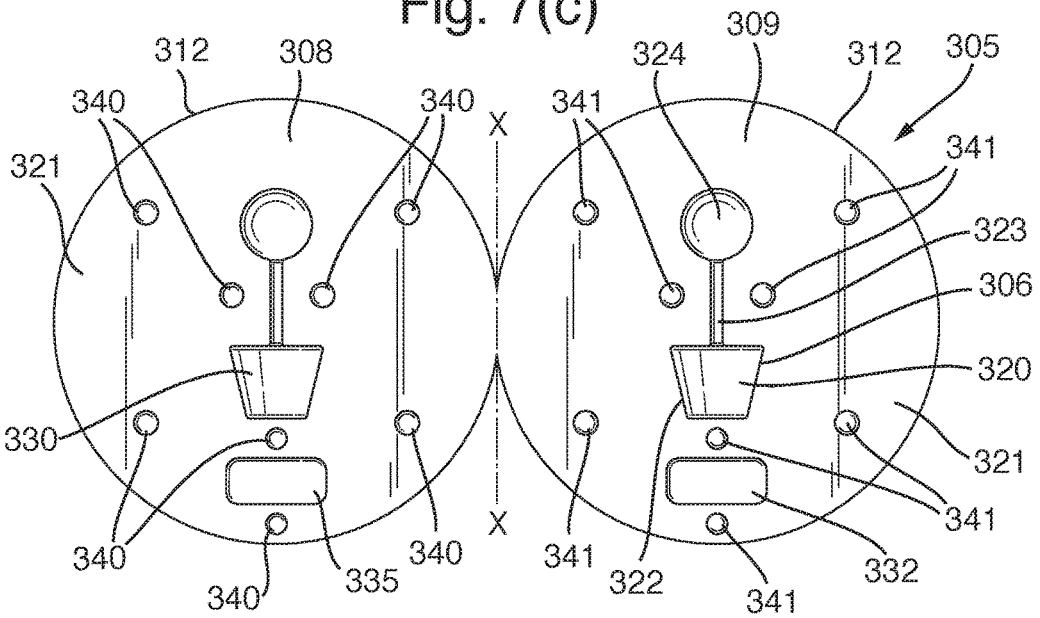
Figure 7D:
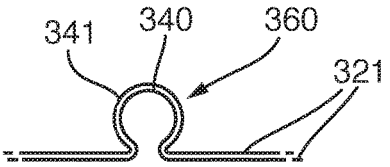
Figure 7E:
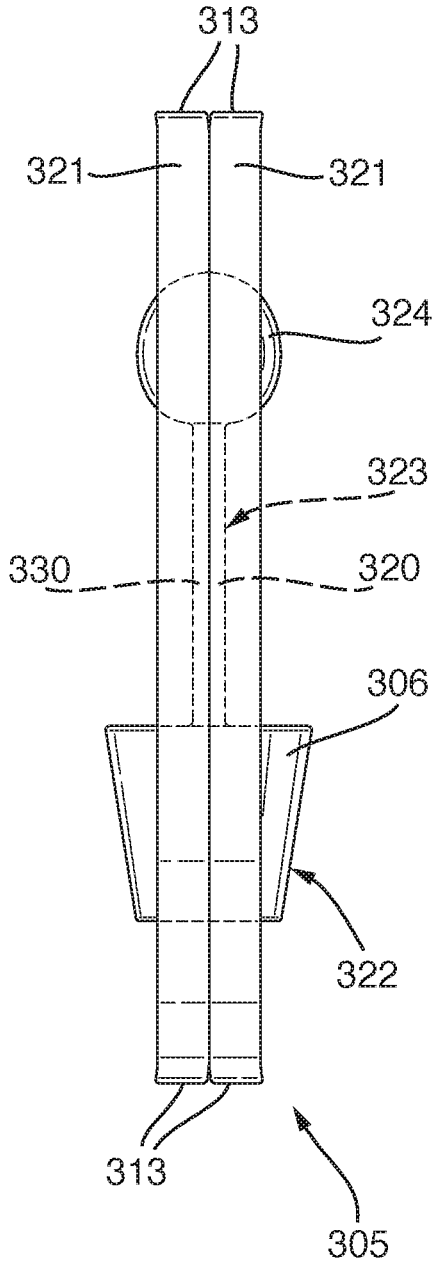
Figure 7F:
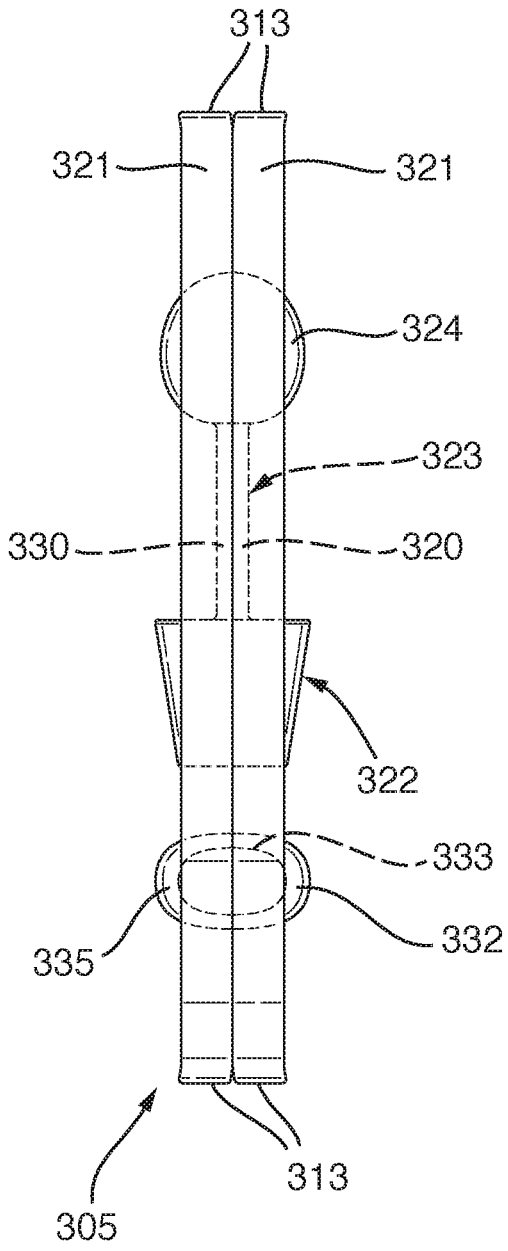
Figure 7G:
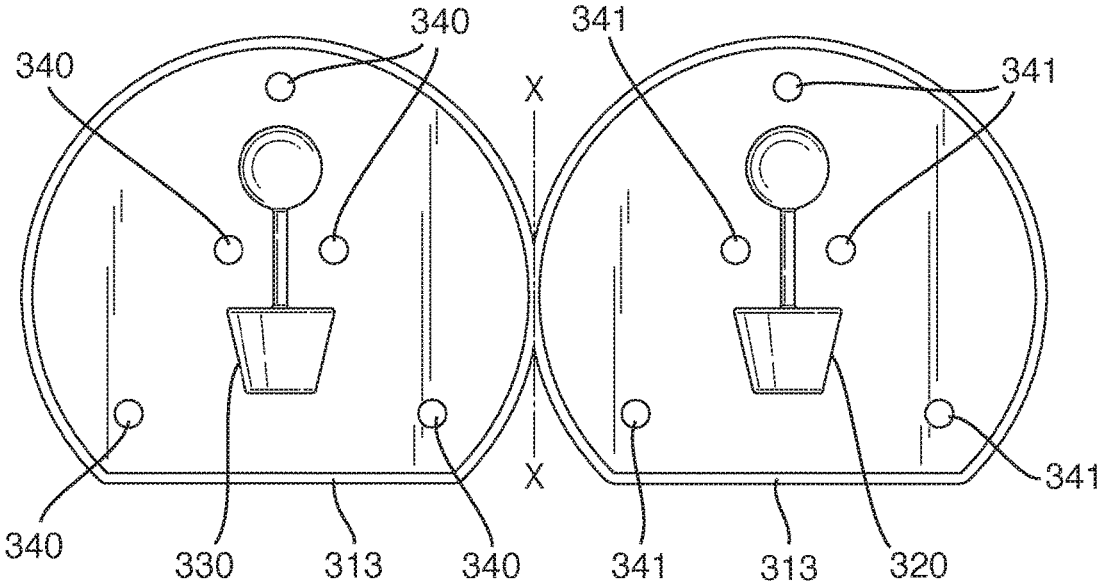
Figure 7H:
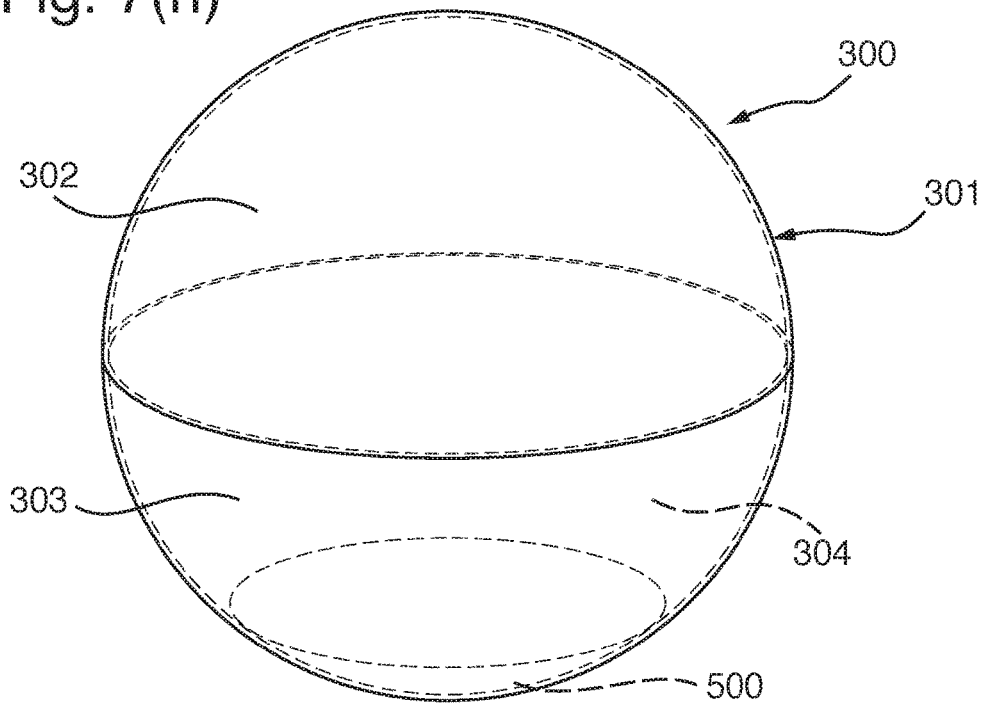

FIG. 6 illustrates a further embodiment of the invention. A transport unit, such as a bulk transport container (200) comprises an outer housing (201), with an access lid (207) and within the outer housing, an inner retaining element (202) which is free to rotate about the axis X, on a spindle (205). The retaining element comprises containers (203) with seals (206) and contents (204) and a biasing mass (202), whose turning moment is sufficient to bias the retaining element, including the containers and their contents in the upward orientation. The containers are attached to the retaining element, such that their orientation is biased by the biasing mass. Thus if the packaging unit is displaced about the axis X, such as when a bulk container is dislodged from a lorry or train, the contents of the containers are maintained upright as the container rolls.

FIG. 6(*a*) is a general view of the transport unit. FIG. 6(*b*) is a longitudinal cross section and FIG. 6(*c*) is a cross section at Y.

FIG. 7

FIG. 7 illustrates particular embodiments of a retaining means. These retaining means are suitable for retaining inter alia, delicate items such as plants. FIG. 7 (*a*) shows a spherical retaining element, suitable for use with the invention (300). The retaining element comprises a hollow sphere (301) comprising two parts (302 and 303), which enable the sphere to be split for access to the inside space (304).

Held within the sphere and attached to it such that it rotates with the sphere is a retaining means (305) comprising a portion (306) for retaining the item (in this case a plant), and a portion adapted to retain a biasing mass (307). The retaining means is in two, generally circular laminar parts (308, 309), which cooperate to retain the item and the biasing mass. The edges of the two circular parts (312) form a pair of lips (313) which are adpressed to the inner surface of the sphere (310) once assembled and hold the retaining means firmly in the retaining element.

FIGS. 7(*b*) and (*c*) illustrate the retaining means in open form (lips 313 not shown for clarity). FIG. 7(*c*) illustrates the retaining means of FIG. 7(*a*). The retaining means comprises two circular laminae (321) which cooperate to retain the item and the biasing mass. The portion for retaining the item (306) comprises an indentation (320) in a circular lamina (321) adapted to hold the item when co-operating with its opposite part (330). A further indentation (332) is adapted to hold a biasing mass (333) in co-operation with its opposite part (335). The two circular laminae may be joined along the axis X and folded together to retain both the item and the biasing mass, or they may be separate. Clips (360) formed as protrusions (340), which clip into indentations (341) formed in the circular laminae hold the two halves of the retaining means together. In this embodiment, intended to retain a plant in a pot, the pot, containing the soil is retained in the portion (322), whilst the stem is held in (323) and the bloom in (324). The mass of the pot and soil may be sufficient to bias the plant into the upright position when placed in the packaging unit; in which case the embodiment of FIG. 7(*b*) may be appropriate, having the same features, but lacking the means to hold the biasing mass. FIG. 7(*d*) illustrates a cross section of one of the clips (360) formed from the two laminae (321) as a protrusion (340) which clips into an indentation (341) in the opposite lamina FIG. 7(*e*) shows a side view of the retaining means of 7(*b*) and FIG. 7(*f*) shows a side view of the retaining means of FIG. 7(*c*). Clips are omitted for clarity. FIG. 7(*h*) shows a spherical retaining element similar to that of FIG. 7(*a*), but which comprises a biasing mass (500). The retaining means of FIG. 7(*g*) is suitable for use with this arrangement.

FIG. 8

FIG. 8 shows a further embodiment of a hollow spherical retaining element (400), which comprises a hollow sphere (401) and a retaining means (402) formed as a receptacle (403) with an opening (404) to the outside of the sphere. The housing element is not shown. The walls of the receptacle are continuous with the walls of the sphere. The receptacle (403) holds an item (405) and is sealed with a cap (406). The cap has a hollow (407) to receive the base of the item (408) and a screw thread (409) that engages a thread in the receptacle (410) so that the cap (406) can be screwed into the receptacle to close it. When closed, the outer face of the cap (413) is contiguous with the surface of the sphere, allowing easier movement of the sphere within the housing. The cap (406) is fabricated from a heavy material such as lead and provides the biasing mass, which biases the item into the upright position, when free to rotate within the outer housing. The upper portion of the sphere is provided with finger holds (411), in the form of perforations of the sphere which allow the sphere to be simply manipulated by hand.

FIG. 9

FIG. 9 illustrates an embodiment of the invention having a ring shaped retaining element suitable for use in a packaging unit or container of the invention. FIG. 9(*a*) shows a general view of a packaging unit or container (500) comprising a hollow spherical housing element (501) having a spherical inner surface (504). The housing is made up of two sub-assemblies, (502 and 503) which co-operate to form the spherical inner surface and allow the sphere to be split at (506) for access to the hollow interior space (507). A retaining element (508) is retained within the housing element and has a retaining means in the form of a receptacle (510) with a lid (511) held in place by a screw thread (512). The receptacle is adapted to hold an item such as a lead shielded radioactive source (513) and is fixed to the retaining element (508). The shielded source is held upright and fixed in place within the receptacle by a liner (514). The outer face of the retaining element comprises a curved surface (515) having a curvature matching that of the inner surface of the housing element (504), such that the retaining element is constrained radially and laterally by the surface (504), but still able to rotate within the housing. The edges of the ring (515) are raised away from the surface (516) in order to reduce the risk of them catching on the inner surface during rotation. Access to the receptacle (510) is achieved by separating the two parts of the housing (502 and 503). An item such as a shielded source can then be easily placed within the receptacle, by removing the lid.

If the outer housing is rotationally displaced the turning moment of the mass of the shielded source acts to rotate the retaining element relative to the housing.

The invention claimed is:

1. A transport packaging unit for transporting a radioactive source in a preferred orientation, the packaging unit comprising an inner retaining element and an outer housing element, the retaining element retained within the housing element and free to rotate about all axes of symmetry, and comprising a retaining means for retaining a radioactive source, the retaining means arranged such that the mass of the radioactive source, when held in the retaining means, biases the retaining element such that the radioactive source is maintained in the preferred orientation.

2. A transport packaging unit according to claim 1, in which the retaining element is constrained radially in all directions from its centre by the housing element.

3. A transport packaging unit according to claim 1 wherein the retaining means retains the radioactive source within the retaining element.

4. A transport packaging unit according to claim 1, wherein the radioactive source is shielded and the mass of the radioactive source and the shielding, when placed in the retaining means, biases the retaining element.

5. A transport packaging unit according to claim 1 wherein the retaining element is spherical.

6. A transport packaging unit according to claim 1 characterized in that the retaining element is hollow.

7. A transport packaging unit according to claim 1 wherein the retaining means is a receptacle opening to the outside of the retaining element.

8. A transport packaging unit according to claim 1 wherein the retaining means is a receptacle opening to the inside of the retaining element.

9. A transport packaging unit according to claim 1 characterized in that the housing element comprises two or more sub elements, that act together to constrain the retaining element, whilst allowing it to rotate.

10. A retaining means for the transport packaging according to claim 1 comprising a means for retaining the radioactive source.

11. A retaining means according to claim 10 adapted for attachment to a retaining element.

* * * * *